US011485935B2

(12) United States Patent
Piorkowski et al.

(10) Patent No.: US 11,485,935 B2
(45) Date of Patent: Nov. 1, 2022

(54) LIQUID DETERGENT COMPOSITIONS INCLUDING STRUCTURANT, SINGLE DOSE PACKS INCLUDING THE SAME, AND METHODS OF FORMING THE SINGLE DOSE PACKS

(71) Applicant: Henkel IP & Holding GmbH, Duesseldorf (DE)

(72) Inventors: Daniel Thomas Piorkowski, Fairfield, CT (US); David S. Stott, II, Madison, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 15/943,037

(22) Filed: Apr. 2, 2018

(65) Prior Publication Data

US 2019/0300823 A1 Oct. 3, 2019

(51) Int. Cl.

| | |
|---|---|
| ***C11D 17/00*** | (2006.01) |
| ***C11D 17/04*** | (2006.01) |
| ***C11D 3/20*** | (2006.01) |
| ***C11D 1/83*** | (2006.01) |
| ***C11D 11/00*** | (2006.01) |
| *C11D 1/74* | (2006.01) |

(52) U.S. Cl.

CPC ..... *C11D 3/2089* (2013.01); *C11D 1/83* (2013.01); *C11D 11/0082* (2013.01); *C11D 17/0013* (2013.01); *C11D 17/0026* (2013.01); *C11D 17/0039* (2013.01); *C11D 17/043* (2013.01); *C11D 17/046* (2013.01); *C11D 1/74* (2013.01)

(58) Field of Classification Search

None

See application file for complete search history.

(56) References Cited

U.S. PATENT DOCUMENTS

| | | | | |
|---|---|---|---|---|
| 7,671,003 | B2 | 3/2010 | Barry et al. | |
| 2006/0140897 | A1 | 6/2006 | Patel et al. | |
| 2006/0270584 | A1 | 11/2006 | Frantz et al. | |
| 2010/0080831 | A1* | 4/2010 | Braeckman ..... | C11D 3/046 424/401 |
| 2011/0065624 | A1 | 3/2011 | Boutique et al. | |
| 2016/0040105 | A1 | 2/2016 | DePoot et al. | |
| 2017/0137758 | A1* | 5/2017 | Vaccaro ..... | C11D 1/22 |
| 2017/0175058 | A1 | 6/2017 | DePoot et al. | |
| 2019/0233768 | A1* | 8/2019 | Piorkowski ..... | C11D 1/83 |

FOREIGN PATENT DOCUMENTS

| | | |
|---|---|---|
| EP | 0637629 A1 | 1/2002 |
| WO | 0125378 A2 | 4/2001 |

OTHER PUBLICATIONS

European Search Report App. No. EP 19 16 6103 Completed: Jul. 10, 2019 10 pages.

* cited by examiner

*Primary Examiner* — Lorna M Douyon

(74) *Attorney, Agent, or Firm* — Bojuan Deng

(57) ABSTRACT

Liquid detergent compositions, single dose packs including the same, and methods of forming single dose packs are provided herein. In an embodiment, a liquid detergent composition includes an ionic surfactant, an alkoxylated linear fatty acid structurant, and, optionally, a particulate component. The structurant is solid at ambient temperature of about 21° C. and ambient pressure of about 100 kPa. The particulate component is different from the structurant. The detergent composition exhibits non-Newtonian fluid behavior at 24 hours following shear mixing cessation.

10 Claims, 5 Drawing Sheets

LIQUID DETERGENT COMPOSITIONS INCLUDING STRUCTURANT, SINGLE DOSE PACKS INCLUDING THE SAME, AND METHODS OF FORMING THE SINGLE DOSE PACKS

TECHNICAL FIELD

The present disclosure generally relates to liquid detergent compositions, single dose packs that include the liquid detergent compositions, and methods of forming the single dose packs. More particularly, the present disclosure relates to liquid detergent compositions that include a structurant that provides non-Newtonian fluid properties to the liquid detergent compositions, as well as single dose packs that include the liquid detergent compositions and methods of forming the single dose packs.

BACKGROUND

Manufacturers of detergent compositions such as laundry detergent compositions, fabric softening compositions, detergent boosters, dishwasher detergent compositions, and the like continually endeavor to improve the performance of the detergent compositions in various ways. In addition to seeking to improve laundering effectiveness of the detergent compositions for removing various types of foreign substances from stained fabric articles, efforts have long been made to provide secondary effects attributable to the detergent compositions, such as delayed release of desirable active agents including fragrance, skin care, and/or textile care components. The delayed release of the active agents provides a long-lasting, persistent effect attributable to use of the detergent compositions.

To provide the delayed release of the active agents, many detergent compositions are formulated to include particulate components, such as microcapsules that deliver the active agents. The microcapsules may provide special delayed release functions such as heat release, mechanical release or other processing-dependent release functions. While microcapsules are a common type of particle included in detergent compositions, it is to be appreciated that various other agents in particle form are also desirably delivered in the detergent compositions.

When the detergent compositions are in liquid form, the microcapsules and other components in particle form are desirably dispersed within a liquid phase of the detergent compositions. However, the particulate components within the detergent compositions may have a tendency to settle out of the liquid phase of the detergent compositions, resulting in inconsistent properties of the detergent compositions. Therefore, it is desirable to provide the detergent compositions with a sufficiently high viscosity to minimize Brownian movement of particulate components within the detergent compositions and to maintain the particulate components in suspension within the liquid detergent compositions for an appreciable amount of time after forming the detergent compositions.

Despite benefits of higher viscosity vis-à-vis maintaining particular components in suspension within the detergent compositions, higher viscosities of the detergent compositions are detrimental to processing of the detergent compositions during manufacture and, possibly, during laundering applications. In particular, during manufacture of detergent compositions, it is desirable for the detergent compositions to have lower viscosities, which enable the detergent compositions to be more easily pumped and filled into containers as compared to compositions having higher viscosities. Lower viscosity of the detergent compositions during pumping and container filling is particularly desirable for single dose packs, which have a relatively low volume of detergent composition per pack than bulk liquid detergent containers.

As known in the art, Newtonian fluids exhibit a commensurate, linear increase in shear stress with increases in shear rate, while non-Newtonian fluids exhibit a non-linear relationship between shear stress and shear rate. Various non-Newtonian fluids can exhibit shear thickening (i.e., an increase in viscosity with increased shear rates) or shear thinning (i.e., a decrease in viscosity with increased shear rate). Non-Newtonian fluids that exhibit shear thinning may have a yield point. The yield point is an oscillation stress at which steeper declines in viscosity are produced, as indicated by shear modulus (G') decline, with further increases in the oscillation stress beyond the yield point also producing the steeper decline in shear modulus. At oscillation stress below the yield point, changes in shear rate with stress have a minimal to no impact on the viscosity of the material. At oscillation stress above the yield point, the material begins to exhibit rapid viscosity decreases with increased levels of stress. For example, referring to FIG. 1, a graph is provided that shows shear modulus (G') versus oscillatory stress for a non-Newtonian illustrative formulation that exhibits a yield point, with testing conducted in two separate trials using a TA Instruments AR-2000EX rheometer with a40 mm, 2 degree cone; oscillation from 0.1 to 100 Pa shear stress over 215 seconds; a gap size of 52 microns; and a temperature of 20° C. To conduct the trials, the illustrative formulation is subjected to an oscillation stress sweep starting at a low amplitude oscillatory (i.e. clockwise then counter clockwise) shear. In the early stages, oscillation stress is sufficiently low to preserve structure in the illustrative formulation. As the oscillation stress is increased, structure of the illustrative formulation is disrupted, i.e., the yield point is exceeded, manifested as a decrease in rigidity (shear modulus, G'). For the illustrative formulation, the yield point was measured at 4.597 Pa and 4.860 Pa for the respective trials.

Efforts have been made to add structurants into liquid detergent compositions, with the structurants providing non-Newtonian shear thinning properties to the liquid detergent compositions once added. Proposed structurants that have been contemplated for liquid detergent compositions include non-polymeric crystalline, hydroxy-functional structurants and/or polymeric structurants. Examples of non-polymeric crystalline, hydroxy-functional structurants that have previously been proposed are hydrogenated castor oil (HCO). Examples of polymeric structurants that have previously been proposed are cellulose and polysaccharide derivatives; hydrophobically modified ethoxylated urethanes (HEUR); polycarboxylates; and polyacrylates.

The aforementioned structurants are generally prepared as an emulsion by homogenizing and emulsifying the structurants under high pressure to achieve a particular droplet size. The emulsified structurant is then added to the liquid detergent compositions. The aforementioned structurants, prepared as described, generally provide the non-Newtonian properties to the liquid detergent compositions virtually immediately upon mixing with the liquid detergent compositions. As such, while the liquid detergent compositions can be substantially formed prior to adding the structurant with benefits associated with low viscosity realized up to the point of adding the structurant, the existing structurants effectively increase viscosity of the liquid detergent compositions immediately upon addition thereto. As such, challenges associated with pumping and filling the liquid detergent compositions into containers may still be experienced due to higher viscosity imparted by the conventional structurants.

Accordingly, it is desirable to provide liquid detergent compositions that include a structure, single dose packs that include the liquid detergent compositions, and methods of forming the single dose packs whereby viscosity of the liquid detergent compositions is sufficiently low to minimize challenges with pumping and filling the liquid detergent compositions into containers while also providing non-Newtonian shear thinning properties to the liquid detergent compositions to hinder separation of particulate components, when present, from the liquid detergent compositions. Furthermore, other desirable features and characteristics of the present disclosure will become apparent from the subsequent detailed description of the disclosure and the appended claims, taken in conjunction with the accompanying drawings and this background of the disclosure.

BRIEF SUMMARY

Liquid detergent compositions, single dose packs including the same, and methods of forming single dose packs are provided herein. In an embodiment, a liquid detergent composition includes a continuous phase and, optionally, a particulate component suspended in the continuous phase. The continuous phase includes an ionic surfactant and an alkoxylated linear fatty acid structurant. The structurant is solid at ambient temperature of about 21° C. and ambient pressure of about 100 kPa. The particulate component is different from the structurant. The detergent composition exhibits non-Newtonian fluid behavior at 24 hours following shear mixing cessation.

In another embodiment, a single dose pack includes a container and a liquid detergent composition encapsulated within the container. The container includes a water-soluble film. The detergent composition includes a continuous phase and, optionally, a particulate component suspended in the continuous phase. The continuous phase includes an ionic surfactant and an alkoxylated linear fatty acid structurant. The structurant is solid at ambient temperature of about 21° C. and ambient pressure of about 100 kPa. The particulate component is different from the structurant. The detergent composition exhibits non-Newtonian fluid behavior at 24 hours following shear mixing cessation.

In another embodiment, a method of forming a single dose pack includes forming a liquid detergent composition and encapsulating the composition within a container to form the single dose pack. The detergent composition includes a continuous phase and, optionally, a particulate component suspended in the continuous phase. The continuous phase includes an ionic surfactant and an alkoxylated linear fatty acid structurant. The structurant is solid at ambient temperature of about 21° C. and ambient pressure of about 100 kPa. The particulate component is different from the structurant. The detergent composition exhibits non-Newtonian fluid behavior at 24 hours following encapsulating the composition within the container.

BRIEF DESCRIPTION OF THE DRAWINGS

The present disclosure will hereinafter be described in conjunction with the following drawing figures, wherein like numerals denote like elements, and wherein.

DETAILED DESCRIPTION

Figure 1:
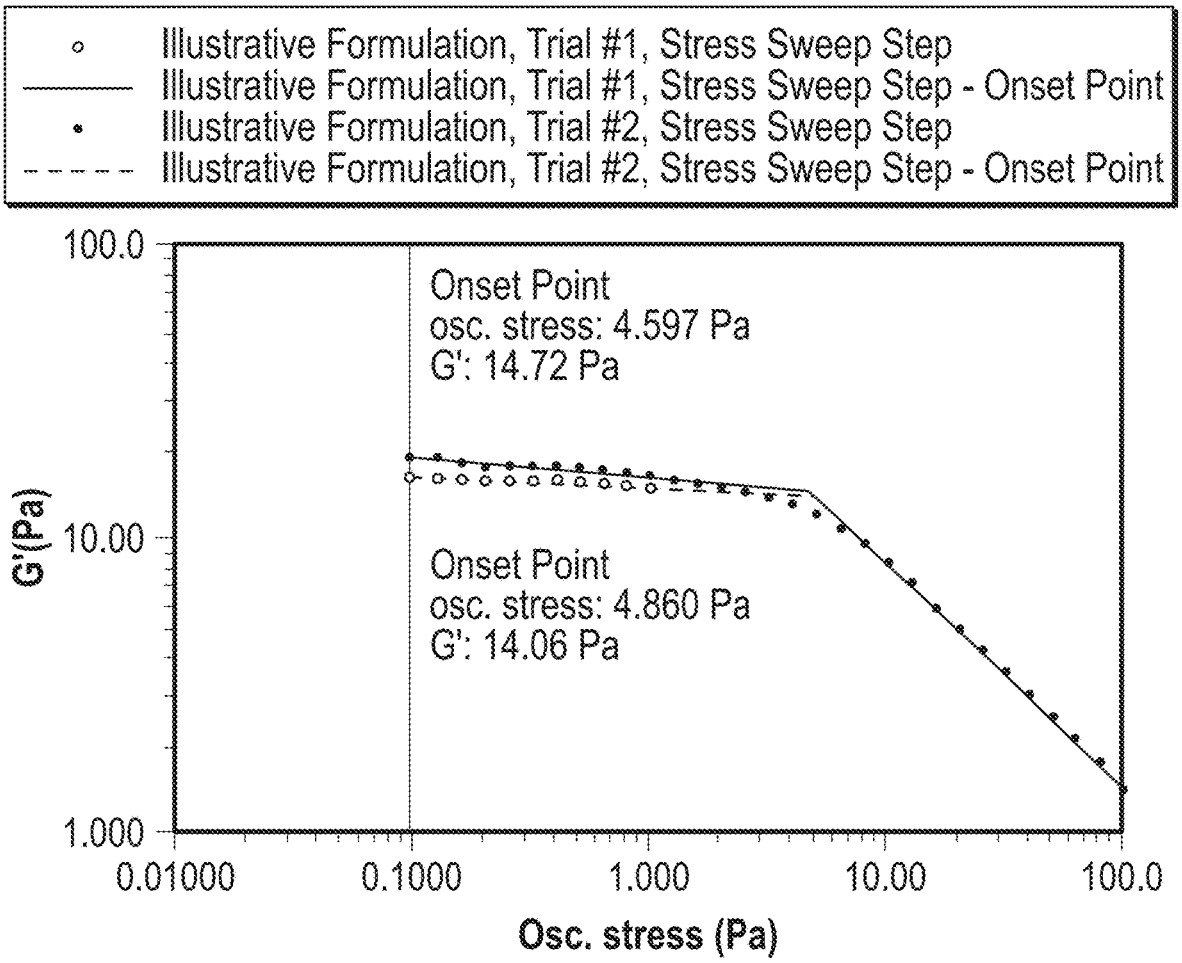
FIG. 1 is a graph of showing shear modulus (G') versus oscillatory stress for a non-Newtonian illustrative formulation that exhibits a yield point.

The following detailed description is merely exemplary in nature and is not intended to limit the detergent compositions, single dose packs, or the methods for producing or using the same. Furthermore, there is no intention to be bound by any theory presented in the preceding background or the following detailed description.

Provided herein are liquid detergent compositions that include a structurant, single dose packs that include the liquid detergent compositions, and methods of forming the single dose packs. More particularly, the liquid detergent composition includes a continuous phase and, optionally, a particulate component suspended in the continuous phase. The continuous phase is a unitary phase of the liquid detergent composition, as visually observed without magnification, within which the particulate component may be suspended when present. The continuous phase includes an ionic surfactant and an alkoxylated linear fatty acid structurant. The particulate component is different from the structurant. It was surprisingly found that alkoxylated linear fatty acid structurant that is solid at ambient temperature of about 21° C. and ambient pressure of about 100 kPa, when combined with the other components of the liquid detergent composition as a hot melt, may set up over time and impart the liquid detergent composition with a yield point, which is indicative of a non-Newtonian fluid that exhibits shear thinning. The yield point is an oscillation stress at which steeper declines in viscosity are produced, as indicated by shear modulus (G') decline, with further increases in the oscillation stress beyond the yield point also producing the steeper decline in shear modulus. At oscillation stress below the yield point, changes in shear rate with stress have a minimal to no impact on the viscosity of the material. At oscillation stress above the yield point, the material begins to exhibit rapid viscosity decreases with increased levels of stress. The detergent compositions as contemplated herein exhibit the non-Newtonian fluid behavior at 24 hours following shear mixing cessation, it being appreciated that the non-Newtonian fluid properties may develop prior to 24 hours following shear mixing cessation provided that the non-Newtonian fluid properties are exhibited at 24 hours following shear mixing cessation. The non-Newtonian shear thinning properties of the liquid detergent composition may minimize Brownian movement of the particulate component, when present, within the liquid detergent compositions during storage and thus hinder separation of particulate components from the liquid detergent compositions. At the same time, because the yield point may develop over time, viscosity of the liquid detergent compositions may remain sufficiently low for a period of time after shear mixing cessation to minimize challenges with pumping and filling the liquid detergent compositions into containers.

"Liquid" or "liquid composition", as referred to herein, are any compositions that have a viscosity. More particularly, for purposes herein, liquids are compositions that flow under influence of a force such as gravity, agitation, etc. It is to be appreciated that the liquid compositions may contain particulate components therein provided that the composition retains a viscosity and the presence of a separate particulate phase does not change the character of the composition from being a liquid.

The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated.

Figure 2:
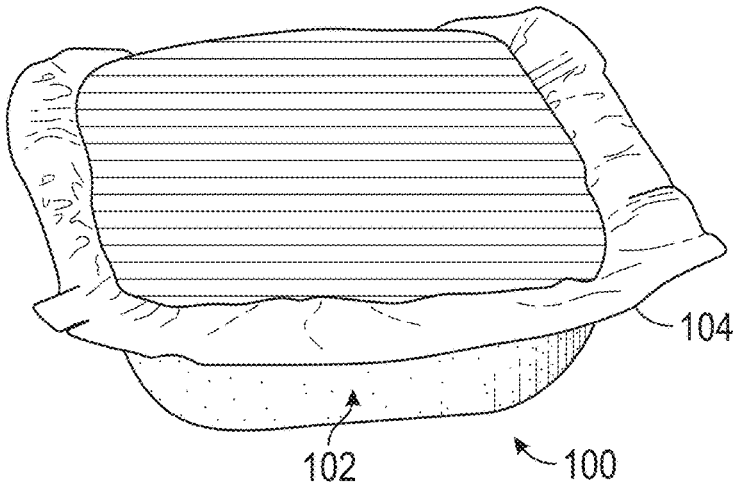
FIG. 2 is a schematic perspective view of a single dose pack in accordance with an embodiment.

An embodiment of a liquid detergent composition and a single dose pack including the same, as contemplated herein, will now be described with reference to FIG. 2. With reference to FIG. 2, a single dose pack 100 is formed by encapsulating a liquid detergent composition 102 within a container 104, where the container 104 includes a film. In this embodiment, the liquid detergent composition 102 includes the particulate component 106. However, it is to be appreciated that the particulate component 106 is optional. In some embodiments, the film forms one half or more of the container 104, where the container 104 may also include dyes, print, or other components in some embodiments. In embodiments, the film is water soluble such that the film will completely dissolve when an exterior of the film is exposed to water, such as in a washing machine typically used for laundry. When the film dissolves, the container 104 is ruptured and the contents are released. As used herein, "water soluble" means at least 2 grams of the solute (the film in one example) will dissolve in 5 liters of solvent (water in one example,) for a solubility of at least 0.4 grams per liter (g/l), at a temperature of 25 degrees Celsius (° C.) unless otherwise specified. Suitable films for packaging are completely soluble in water at temperatures of about 5° C. or greater.

In embodiments, the film is desirably strong, flexible, shock resistant, and non-tacky during storage at both high and low temperatures and high and low humidities. In an exemplary embodiment, the film is initially formed from polyvinyl acetate, and at least a portion of the acetate functional groups are hydrolyzed to produce alcohol groups. Therefore, the film includes polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 75 to about 90 μm in various embodiments. The film may include alternate materials in some embodiments, such as methyl hydroxy propyl cellulose and polyethylene oxide, but the film is water soluble in all embodiments.

The single dose pack 100 may be formed from a container 104 having a single section, but the single dose pack 100 may be formed from containers 104 with two or more different sections in alternate embodiments. In embodiments with a container having two or more sections, the contents of the different sections may or may not be the same.

As alluded to above, the liquid detergent composition 102 includes the continuous phase that includes an ionic surfactant and an alkoxylated linear fatty acid structurant. It is to be appreciated that additional components may be included in the liquid detergent composition 102 in accordance with the present disclosure and as addressed below. However, the ionic surfactant and the alkoxylated linear fatty acid structurant are the components of the liquid detergent composition 102 that provide the context and desired performance for the liquid detergent compositions 102 as described herein.

In embodiments, the ionic surfactant is a detergent surfactant that is formulated for laundry applications. In other embodiments, the ionic surfactant may be formulated for dishwashing applications. The liquid detergent composition 102 may include one or more ionic surfactants, including cationic and/or anionic surfactants, in various embodiments. The ionic surfactant may be present in the liquid detergent composition 102 at a concentration of from about 5 to about 55 weight percent in one embodiment, but the ionic surfactant may be present in the liquid detergent composition 102 at a concentration of about 10 to about 30 weight percent or from about 20 to about 25 weight percent in alternate embodiments, where all weight percents are based on a total weight of the liquid detergent composition 102.

Suitable ionic surfactants that are anionic include soaps which contain sulfate or sulfonate groups, including those with alkali metal ions as cations. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms, and/or alcohol ethoxysulfates. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters, and lauryl ether sulfates.

Suitable ionic surfactants that are cationic may include textile-softening substances of the general formula X, XI, or XII as illustrated below:

(X)

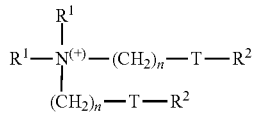

(XI)

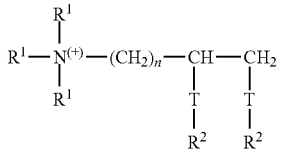

(XII)

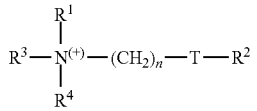

in which each $R^1$ group is mutually independently selected from among $C_{1-6}$ alkyl, alkenyl or hydroxyalkyl groups; each $R^2$ group is mutually independently selected from among $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO—, or —CO—O—, and n is an integer from 0 to 5. The ionic surfactants that are cationic may include conventional anions of a nature and number required for charge balancing. Alternatively, the ionic surfactant may include anionic surfactants that may function to balance the charges with the cationic surfactants. In some embodiments, ionic surfactants that are cations may include hydroxyalkyltrialkylammonium compounds, such as $C_{12-18}$ alkyl(hydroxyethyl)dimethyl ammonium compounds, and may include the halides thereof, such as chlorides or other halides. The ionic surfactants that are cations may be especially useful for compositions intended for treating textiles.

Nonionic surfactants may optionally be present in the liquid detergent composition 102, with the nonionic detergent surfactants not including alkoxylated linear fatty acids for purposes of the present disclosure. The nonionic surfactants may be present at a concentration of from about 0 to about 60 weight percent, or from about 5 to about 50 weight percent, or from about 10 to about 30 weight percent, or from about 20 to about 40 weight percent in various embodiments. Suitable nonionic surfactants include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

Figure 4:
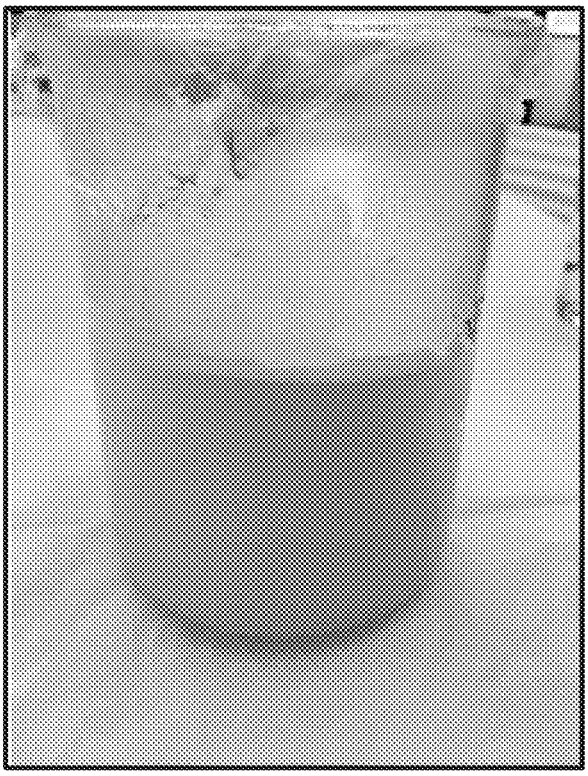
FIG. 4 is a photograph of a liquid detergent composition in accordance with the present disclosure, with the photograph illustrating the composition as being visually opaque due to precipitation and structuring of alkoxylated linear fatty acid structurant in the composition after a setting time of 24 hours at about 21° C.

As set forth above, the liquid detergent compositions 102 further include the alkoxylated linear fatty acid structurant. The alkoxylated linear fatty acid structurant is solid at ambient temperature of about 21° C. and ambient pressure of about 100 kPa. It was found that by including the alkoxylated linear fatty acid structurant, a combination of desirable properties for the liquid detergent compositions 102 was achieved in that the compositions set up over time and develop higher viscosity (which hinders settling of the particulate component 106, when present, from the composition) but still remain flowable while exhibiting Newtonian fluid properties for a period of time after shear mixing (which is desirable for pumpability and filling of containers). In particular, when the alkoxylated linear fatty acid structurant is mixed with the other components of the liquid detergent composition 102 as a hot melt, the alkoxylated linear fatty acid structurant provides for in-vitro development of the yield point by forming structurant precipitate within the liquid detergent compositions 102 over time, e.g., by 24 hours after shear mixing. Without being bound by theory, it is believed that the structurant precipitates or solidifies out of solution over time after being added as a hot melt with the precipitate in the form of needle-like structures. It is believed that the needle-like structures form a network by sticking/entangling with each other to give rise to the yield point. Development of the yield point is indicative of a non-Newtonian fluid that exhibits shear thinning. Referring momentarily to FIG. 4, the liquid detergent composition 102 appears visibly opaque, which is indicative of a composition that has developed non-Newtonian fluid properties. It is believed that the non-Newtonian fluid properties that develop over time provide desirably high viscosity that is beneficial for suspending and inhibiting Brownian movement of the particulate component 106 in solution, when present. However, because the non-Newtonian fluid properties develop over time, the liquid detergent composition 102 exhibits a relatively lower viscosity when the composition is processed, e.g., during filling of single dose packs. Further, due to the non-Newtonian fluid properties of the liquid detergent compositions 102, a more favorable dissolution rate of the composition can be realized upon agitation, e.g., during a wash cycle, whereas with Newtonian gel that doesn't shear thin, it will take more time for the structure to break down and provide detergency for washing.

In embodiments, the alkoxylated linear fatty acid structurant is formed from a C13-C22 fatty acid, such as from a C15-C20 fatty acid, provided that the alkoxylated linear fatty acid structurant is solid at ambient temperature of about 21° C. and ambient pressure of about 100 kPa. In specific embodiments, the alkoxylated linear fatty acid is formed from stearic acid. In embodiments, the alkoxylated linear fatty acid structurant includes from about 6 to about 10 ethylenoxy units. In embodiments, the alkoxylated linear fatty acid structurant has a density of from about 0.90 to about 1.10 g/ml, or from about 1.00 to about 1.06 g/ml. In specific embodiments, the alkoxylated linear fatty acid structurant includes about 8 ethylenoxy units. One specific example of a suitable alkoxylated linear fatty acid structurant is polyethylene glycol stearate having a molar average of 8 ethylenoxy units per molecule (PEG 8 stearate), which has a density of about 1.00 g/ml. Other examples of specific alkoxylated linear fatty acid structurants that may be suitable include PEG 8 palmitate, PEG 8 myristate, PEG 8 arachidate, PEG 10 stearate, PEG 10 palmitate, and PEG 6 arachidate. It is to be appreciated that the alkoxylated linear fatty acid structurant may include other alkylenoxy unit(s) in some embodiments, such as propylenoxy. However, to the extent that non-ethylenoxy unit(s) are present in the alkoxylated linear fatty acid structurant, such units are present in small amounts such as 1 or 2 units per molecule. In embodiments, the alkoxylated linear fatty acid structurant is formed from C13-C22 fatty acid, has from about 6 to about 10 ethylenoxy units, and is free from additional alkylenoxy units provided that the alkoxylated linear fatty acid structurant is solid at ambient temperature of about 21° C. and ambient pressure of about 100 kPa.

It is believed that the amount of alkoxylated linear fatty acid structurant in the liquid detergent composition 102 also contributes to development of the yield point, with too little of the alkoxylated linear fatty acid structurant resulting in failure to form sufficient precipitation of the structurant to stabilize the composition and with excess alkoxylated linear fatty acid structurant resulting in excessive precipitation of the structurant in the liquid detergent composition 102. In embodiments, the alkoxylated linear fatty acid structurant is present in an amount higher than a saturation point of the structurant in the liquid detergent composition 102 at ambient temperature of about 21° C. With the alkoxylated linear fatty acid structurant added as a hot melt during formation of the liquid detergent composition, precipitation of the structurant is promoted upon cooling and settling time. Without being bound by theory, it is believed that the structurant precipitates or solidifies out of solution over time after being added as a hot melt with the precipitate in the form of needle-like structures in crystalline form. It is believed that the needle-like structures form a network by sticking/entangling with each other to give rise to the yield point. In embodiments, the alkoxylated linear fatty acid structurant is present in an amount of from about 5 to about 15 weight %, from about 7 to about 11 weight %, from about 6 to about 10 weight %, from about 7 to 9 weight %, or about 8 weight %, with all amounts based upon the total weight of the liquid detergent composition 102.

The particulate component 106 of the detergent composition 102 encompasses all solid particles that are added to the detergent composition 102 as solid particles, and that remain as solid particles and visibly distinct from the continuous phase after shear mixing the components to form the detergent composition 102. In effect, the liquid detergent compositions 102 generally have the continuous phase, with the particulate component 106 suspended in the continuous phase when the particulate component 106 is present. By the term "suspended", it means that the particulate component 106 does not separate or precipitate from the other phases of the liquid composition, and the particles of the particulate component 106 are generally evenly dispersed within the continuous phase. The particulate component 106 is different from the structurant and does not include the structurant, which is added as a hot melt during formation of the detergent composition 102. More specifically, the particulate component 106 is distinguishable from the structurant in that the particulate component 106 is mixed in and remains in particle form at all stages of processing, i.e., the particulate component does not melt. The particulate component 106 may include microcapsules, and may further include additional particles such as fillers, thickeners, and the like. In embodiments, the microcapsules include one or more active ingredients. Examples of active ingredients include, but are not limited to, perfumes, softening agents, anti-static agents, refreshing agents, anti-microbial agents, disinfecting agents, anti-wrinkle agents, malodor control agents, insect/pet repellents, skin/fabric conditioning agents, silicones, antimicrobials, brighteners, bleaches, antifoams, and combinations thereof. In one embodiment the active ingredient included in the microcapsules includes a perfume. Non-limiting examples of suitable perfumes include blooming perfumes, perfume oils, and perfume raw materials comprising alcohols, ketones, aldehydes, esters, ethers, nitriles alkenes, and mixtures thereof.

In various embodiments, the microcapsules are friable microcapsules, moisture-activated microcapsules, heat-activated microcapsules, or combinations thereof "Friability" refers to the propensity of the microcapsules to rupture or break open when subjected to direct external pressures or shear forces. For purposes of the present disclosure, the microcapsules utilized are "friable" if, while attached to fabrics treated therewith, they can be ruptured by the forces encountered when the capsule-containing fabrics are manipulated by being worn or handled (thereby releasing the contents of the capsule).

Typically, microcapsules include a spherical hollow shell of water insoluble or at least partially water insoluble material, typically polymer material, within which the active ingredient is encapsulated. Useful shell materials include materials selected from the group of polyethylenes, polyamides, polystyrenes, polyisoprenes, polycarbonates, polyesters, polyacrylates, polyureas, polyurethanes, polyolefins, polysaccharides, epoxy resins, vinyl polymers, and mixtures thereof. Suitable shell materials include materials selected from the group of reaction products of one or more amines with one or more aldehydes, such as urea cross-linked with formaldehyde or gluteraldehyde, melamine cross-linked with formaldehyde; gelatin-polyphosphate coacervates optionally cross-linked with gluteraldehyde; gelatin-gum Arabic coacervates; cross-linked silicone fluids; polyamine reacted with polyisocyanates; and mixtures thereof. In one specific embodiment, the shell material includes melamine cross-linked with formaldehyde.

Microcapsules may be prepared using a range of conventional methods, such as interfacial polymerization, and polycondensation. Through these methods, a thin polymer shell is created around droplets or particles of an active ingredient emulsified or dispersed in a carrier liquid.

In embodiments, the particulate component 106 has a D50 particle size of 30 microns or less, from about 10 microns to about 30 microns, or 20 microns or less. In embodiments, D90 average particle size is 150 microns or less, 50 microns or less, or 30 microns or less, which average particle sizes are sufficient to maintain a stable suspension of the particulate component 106 within the continuous phase of the liquid detergent composition upon development of the yield point. In embodiments, the particulate component has a density of from about 0.9 to about 1.2 g/ml, or from about 1.0 to about 1.08 g/ml, or from about 1.05 to about 1.1 g/ml. In embodiments, a total amount of the particulate component present in the liquid detergent composition 102 is from about is from about 0.01% to about 15% by weight, or from about 0.1 to about 5%, or from about 0.25 to about 3%, based upon the total weight of the liquid detergent composition 102.

Additional components that may be included in the liquid detergent composition 102 beyond those listed above include, but are not limited to, enzymes, anti-redeposition agents, neutralizers, foam inhibitors, bittering agents, and combinations thereof. It is to be appreciated that various other conventional components may also be included in the liquid detergent composition 102.

Possible enzymes that may be in the liquid detergent composition 102 contemplated herein include one or more of a protease, lipase, cutinase, amylase, carbohydrase, cellulase, pectinase, mannanase, arabinase, galactanase, xylanase, oxidase, (e.g., a laccase), and/or peroxidase, but others are also possible. In general, the properties of the selected enzyme(s) should be compatible with the selected liquid detergent composition 102, (i.e., pH-optimum, compatibility with other enzymatic and non-enzymatic ingredients, etc.). The detergent enzyme(s) may be included in the liquid detergent composition 102 by adding separate additives containing one or more enzymes, or by adding a combined additive comprising all the enzymes that are added to the liquid detergent composition 102. The enzyme (s) should be present in the liquid detergent composition 102 in effective amounts, such as from about 0 weight percent to about 5 weight percent of enzyme, or from about 0.001 to about 1 weight percent, or from about 0.2 to about 2 weight percent, or from about 0.5 to about 1 weight percent, based on the total weight of the liquid detergent composition 102, in various embodiments.

One or more anti-redeposition agents may also be optionally included in the liquid detergent composition 102. Anti-redeposition agents include polymers with a soil detachment capacity, which are also known as "soil repellents" due to their ability to provide a soil-repelling finish on the treated surface, such as a fiber. One example in regard to polyesters includes copolyesters prepared from dicarboxylic acids, such as adipic acid, phthalic acid or terephthalic acid. Ethoxylated polyethyleneimines may also serve as effective anti-redeposition agents. The anti-redeposition agent may be present in the liquid detergent composition 102 at an amount of from about 0 to about 3 weight percent, or an amount of from about 0 to about 2 weight percent, or an amount of from about 0 to about 1 weight percent, based on the total weight of the liquid detergent composition 102, in various embodiments.

Neutralizers are optionally included in the liquid detergent composition 102. Exemplary neutralizers include, but are not limited to, sodium hydroxide, triethanol amine, monoethanol amine, buffers, or other compounds that adjust the pH of the liquid detergent composition 102. Neutralizers may be present in the liquid detergent composition 102 at an amount of from about 0 to about 5 weight percent in some embodiments, based on the total weight of the liquid detergent composition 102, but in other embodiments the neutralizer may be present in the liquid detergent composition 102 at an amount of from about 0 to about 3 weight percent, or an amount of from about 0 to about 2 weight percent, based on the total weight of the liquid detergent composition 102.

Foam inhibitors may also optionally be included in the liquid detergent composition 102. Suitable foam inhibitors include, but are not limited to, soaps of natural or synthetic origin, which include an elevated proportion of $C_{18}$-$C_{24}$ fatty acids. Suitable non-surfactant foam inhibitors are, for example, organopolysiloxanes and mixtures thereof with microtine, optionally silanized silica as well as paraffins, waxes, microcrystalline waxes and mixtures thereof with silanized silica or bis-fatty acid alkylenediamides. Mixtures of different foam inhibitors may also be used, for example mixtures of silicones, paraffins or waxes. In an exemplary embodiment, mixtures of paraffins and bistearylethylenediamide may be used. The liquid detergent composition 102 may include the foam inhibitor at an amount of from about 0 to about 5 weight percent, but in other embodiments the foam inhibitor may be present at an amount of from about 0.05 to about 3 weight percent, or an amount of from about 0.5 to about 2 weight percent, based on the total weight of the liquid detergent composition 102.

Bittering agents may optionally be added to hinder accidental ingestion of the single dose pack 100 or the liquid detergent composition 102. Bittering agents are compositions that taste bad, so children or others are discouraged from accidental ingestion. Exemplary bittering agents include denatonium benzoate, aloin, and others. Bittering agents may be present in the liquid detergent composition 102 at an amount of from about 0 to about 1 weight percent, or an amount of from about 0 to about 0.5 weight percent, or an amount of from about 0 to about 0.1 weight percent in various embodiments, based on the total weight of the liquid detergent composition 102.

Several other components may optionally be added to and included in the liquid detergent composition 102 in addition to those described above, including but not limited to peroxy compounds, bleach activators, optical brighteners, chelators, dye transfer inhibitors, soil release agents, water softeners, and other components. A partial, non-exclusive list of additional components (not illustrated) that may be added to and included in the liquid detergent composition 102 include electrolytes, pH regulators, graying inhibitors, anti-crease components, bleach agents, colorants, scents, processing aids, antimicrobial agents, and preservatives.

It is to be appreciated that additional structurants may be included in the liquid detergent composition, with such structurants known in the art. Examples of additional structurants include hydrogenated castor oil structurants, crystallizable glyceride, cellulose-based structurants, hydrophobically-modified ethoxylated urethanes (HEUR), hydrophobically modified alkali swellable emulsion (HASE), and combinations thereof. It is also to be appreciated that certain other components that may be present in the liquid detergent composition may be documented as providing structuring function. In embodiments, the liquid detergent composition is free of sufficient amounts of any additional structurants or other components that may provide structurant function, other than the alkoxylated linear fatty acid structurant, to provide a yield point in the liquid detergent composition. In particular, to the extent that any additional structurants or other components that may provide structurant function are present in the liquid detergent composition, the liquid detergent composition will not develop the in-vitro yield point as described herein in the absence of the alkoxylated linear fatty acid structurant.

Figure 3:
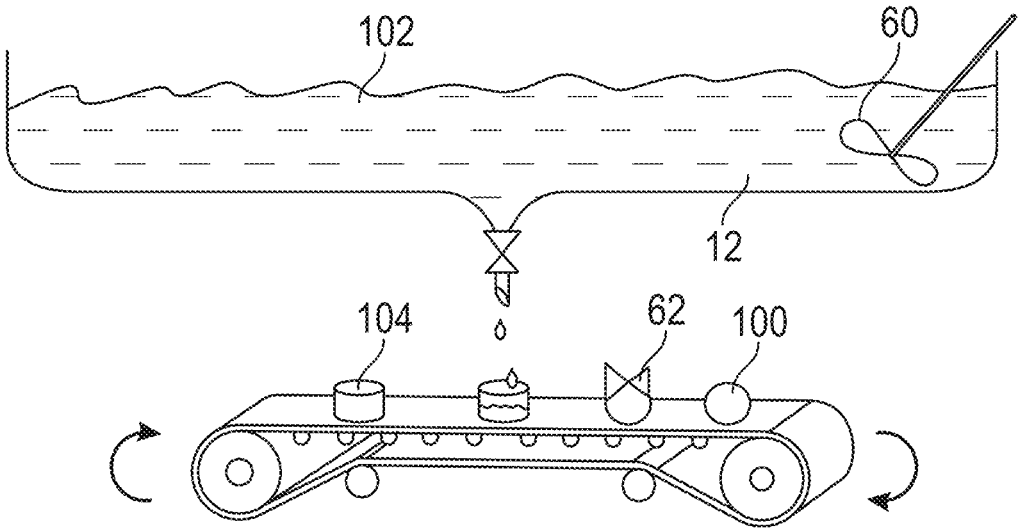
FIG. 3 is a schematic view of a method of making a single dose pack in accordance with an embodiment.

An embodiment of a method of forming a single dose pack 100 will now be described with reference to FIG. 3. The liquid detergent composition 102 is first formed by combining the ionic surfactant, the alkoxylated linear fatty acid structurant, and optionally the particulate component 106. In particular, the alkoxylated linear fatty acid structurant is heated above a melting temperature thereof to form a hot melt, and the hot melt, the ionic surfactant, and the optional particulate component 106 are combined under shear mixing after forming the hot melt. Shear mixing may be conducted using an over-the-head mixer such as an IKA RW 20 Digital Mixer at 500 rpm. The liquid detergent composition 102 is encapsulated within a container 104 by depositing the liquid detergent composition 102 within the container 104. The container 104 is sealed to encase and enclose the liquid detergent composition 102 within the container 104 to form the single dose pack 100. The liquid detergent composition 102 is typically in direct contact with the film of the container 104 within the single dose pack 100. The film of the container 104 is sealable by heat, heat and water, ultrasonic methods, or other techniques, as indicated at 62 in FIG. 3, and one or more sealing techniques may be used to enclose the liquid detergent composition 102 within the container 104.

The liquid detergent composition 102 exhibits Newtonian fluid behavior during at least a portion of a period of time starting at shear mixing cessation until 24 hours following shear mixing cessation. In particular, the liquid detergent composition 102 desirably exhibits Newtonian fluid behavior at the time of encapsulating the liquid detergent composition 102 within the container 104 due to encapsulating occurring shortly after the shear mixing cessation (e.g., less than 5 minutes, or less than 1 minute) and also due to a lack of settling time prior to encapsulation, with settling time required for in-vitro precipitation of the structurant. In embodiments, the liquid detergent composition 102 exhibits Newtonian behavior for at least 3 hours after shear mixing cessation with the detergent composition 102 at about 21° C.

The detergent composition exhibits non-Newtonian fluid behavior at 24 hours following shear mixing cessation, at about 21° C., e.g., after encapsulating the detergent composition 102 within the container 104 to form the single dose pack 100. It is to be appreciated that the non-Newtonian fluid behavior can arise prior to 24 hours so long as the non-Newtonian fluid behavior develops by 24 hours. The liquid detergent composition 102 is visibly clear within 3 hours after encapsulating the composition within the container, at about 21° C., which is a visual indicator that precipitation of the structurant has yet to occur with precipitation of the structurant generally correlated to development of non-Newtonian fluid properties. The liquid detergent composition 102 becomes visibly opaque within about 24 hours following shear mixing cessation and, effectively, from the time of encapsulating the composition within the container, at about 21° C., which is a visual indicator that non-Newtonian fluid properties have developed and that the compositions have developed a yield point. Additionally, phase separation is not visibly observed with liquid detergent compositions 102 as contemplated herein, and a stable single phase can be maintained for at least 1 month, at least 3 months, or from 1 to 6 months.

The yield point of the liquid detergent compositions 102 may be determined through conventional techniques. The yield point is an oscillation stress at which steeper declines in viscosity are produced, as indicated by shear modulus (G') decline, with further increases in the oscillation stress beyond the yield point also producing the steeper decline in shear modulus. At oscillation stress below the yield point, changes in shear rate with stress have a minimal to no impact on the viscosity of the material. At oscillation stress above the yield point, the material begins to exhibit rapid viscosity decreases with increased levels of stress. For example, referring momentarily to FIG. 5, a graph is provided that shows shear modulus (G') versus oscillatory stress for a liquid detergent composition that exhibits a yield point, with testing conducted in two separate trials using a TA Instruments AR-2000EX rheometer with a 40 mm, 2 degree cone; oscillation from 0.1 to 100 Pa shear stress over 215 seconds; a gap size of 52 microns; and a temperature of 20° C. The graph of FIG. 5 corresponds to the liquid detergent composition of FIG. 4, which is visibly opaque. To conduct the trials, the liquid detergent composition is subjected to an oscillation stress sweep starting at a low amplitude oscillatory (i.e. clockwise then counter clockwise) shear. In the early stages, oscillation stress is sufficiently low to preserve structure in the illustrative formulation. As the oscillation stress is increased, structure of the illustrative formulation is disrupted, i.e., the yield point is exceeded, manifested as a decrease in rigidity (shear modulus, G'). For the liquid detergent composition tested, the yield point was measured at 1.479 Pa and 0.7844 Pa for the respective trials.

EXAMPLES

The present disclosure is now illustrated by the following non-limiting examples. It should be noted that various changes and modifications can be applied to the following examples and processes without departing from the scope of this disclosure, which is defined in the appended claims. Therefore, it should be noted that the following examples should be interpreted as illustrative only and not limiting in any sense.

Various different detergent compositions were prepared according to the foregoing description, with samples provided having varied amounts of PEG 8 stearate, samples provided having alkoxylated stearate with varied degrees of ethoxylation, and a sample that includes only PEG 400 (which has an equivalent number average molecular weight as PEG 8 stearate but which does not contain a fatty acid portion) with no PEG stearate. The values shown in TABLE 1 below are in weight % based upon the total weight of the liquid detergent compositions.

TABLE 1

| | Ex. 1 | Ex. 2 | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| Glycerine | 9.00 | 10.36 | 9.00 | 9.00 | 9.00 | 9.00 | 9.00 | 10.36 |
| C12-C15 Alcohol Ethoxylate 7EO | 23.07 | 23.07 | 23.07 | 23.07 | 23.07 | 23.07 | 23.07 | 23.07 |
| Propylene Glycol | 7.00 | 8.00 | 7.00 | 7.00 | 7.00 | 7.00 | 7.00 | 8.00 |
| Neutralizers and Coconut Fatty Acid | 5.5 | 5.5 | 5.5 | 5.5 | 5.5 | 5.5 | 5.5 | 5.5 |
| Zeolite Water | 8.00 | 10.00 | 8.00 | 8.00 | 8.00 | 8.00 | 8.00 | 10.00 |
| Sodium C12-C14 Alcohol Ethoxysulfate 3EO (AES), 60 wt. % Active | 22.72 | 22.72 | 22.72 | 22.72 | 22.72 | 22.72 | 22.72 | 22.72 |
| Enzyme Solution (~8 wt. % Active) | 1.50 | 1.50 | 1.50 | 1.50 | 1.50 | 1.50 | 1.50 | 1.50 |
| Optical Brightener | 0.20 | 0.20 | 0.20 | 0.20 | 0.20 | 0.20 | 0.20 | 0.20 |
| Thickener and Bittering Agents | 2.05 | 2.05 | 2.05 | 2.05 | 2.05 | 2.05 | 2.05 | 2.05 |
| PEG 400 | 12.96 | 8.60 | 16.96 | 4.96 | 12.96 | 12.96 | 12.96 | 16.60 |
| PEG 20 Stearate | 0.00 | 0.00 | 0.00 | 0.00 | 8.00 | 0.00 | 0.00 | 0.00 |
| PEG 40 Stearate | 0.00 | 0.00 | 0.00 | 0.00 | 0.00 | 8.00 | 0.00 | 0.00 |
| PEG 100 Stearate | 0.00 | 0.00 | 0.00 | 0.00 | 0.00 | 0.00 | 8.00 | 0.00 |
| PEG 8 Stearate | 8.00 | 8.00 | 4.00 | 16.00 | 0.00 | 0.00 | 0.00 | 0.00 |
| Total | 100.00 | 100.00 | 100.00 | 100.00 | 100.00 | 100.00 | 100.00 | 100.00 |

Various of the above-listed components contain water and are not 100% active. In particular, the glycerine contains 0.25 weight % water; the C12-C15 alcohol ethoxylated with 7 ethylene oxide groups contains 0.2 weight % water; the propylene glycol contains 0.12 weight % water; the sodium C12-C14 alcohol ethoxysulfate with 3 ethylene oxide groups (AES) contains 24.5 weight % water; and the Thickener contains 20 weight % water.

To form the various liquid detergent compositions, all of the ingredients are mixed together with the PEG/PEG Stearate components added as a hot melt, with the hot melt prepared at a temperature under which the PEG Stearate melted into a flowable, translucent liquid, e.g., about 65° C., under vigorous shear mixing. The ingredients were subject to shear mixing using an over-the-head mixer, such as a IKA RW 20 Digital Mixer at 500 rpm. After shear mixing, the various Examples and Comparative Examples were introduced into vessels and maintained at ambient temperature for a period of up to four months, with observation and yield point testing of the compositions conducted at 1 hour, 24 hours and 48 hours to determine if a yield point has developed. The various Examples and Comparative Examples were tested for yield point through conventional techniques. For example, testing was conducted using a TA Instruments AR-2000EX rheometer with a 40 mm, 2 degree cone; oscillation from 0.1 to 100 Pa shear stress over 215 seconds; a gap size of 52 microns; and a temperature of 20° C. The liquid detergent compositions were subjected to an oscillation stress sweep starting at a low amplitude oscillatory (i.e. clockwise then counter clockwise) shear. TABLE 2 below summarizes the results of the testing for the Examples and Comparative Examples.

TABLE 2

| | | |
|---|---|---|
| Ex. 1 | Precipitate formation verified, yield point verified | Visibly opaque after 24 hours |
| Ex. 2 | Precipitate formation verified, yield point verified (see FIG. 5) | Visibly opaque after 24 hours, and after four months |
| Comp. Ex. 1 | No Precipitate formation, not tested for yield point | Visibly clear |
| Comp. Ex. 2 | Uneven Precipitate Distribution | Separate phases visibly apparent |
| Comp. Ex. 3 | Uneven Precipitate Distribution | Separate phases visibly apparent |
| Comp. Ex. 4 | Uneven Precipitate Distribution | Separate phases visibly apparent |
| Comp. Ex. 5 | Uneven Precipitate Distribution | Separate phases visibly apparent |
| Comp. Ex. 6 | No Precipitate formation, yield point tested and material confirmed to have no yield point (see FIGS. 8 and 9) | Visibly clear |

Figure 5:
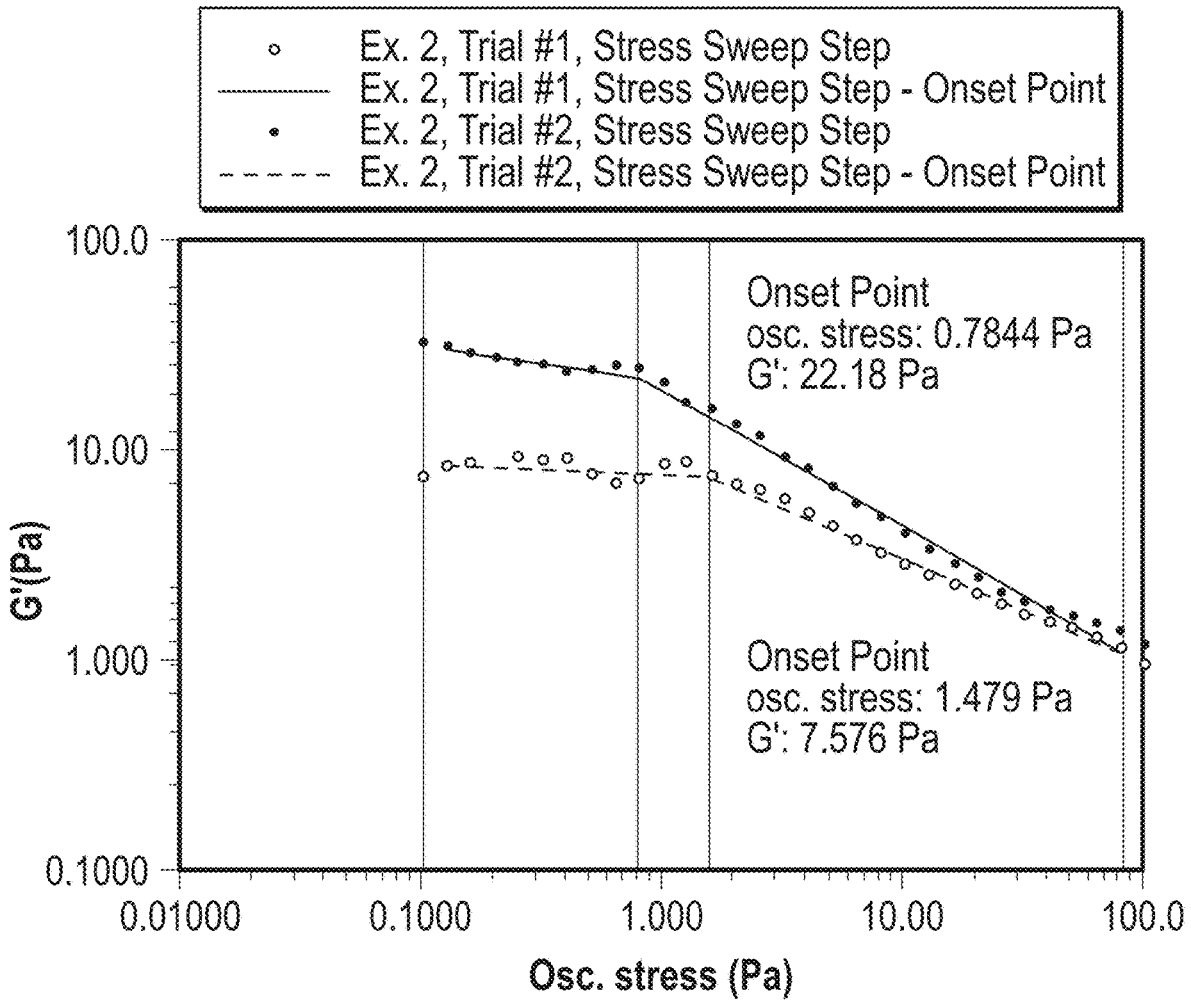
FIG. 5 is a graph of showing shear modulus (G') versus oscillatory stress for the liquid detergent composition of FIG. 4, with the graph illustrating a yield point for the composition.
Figure 6:
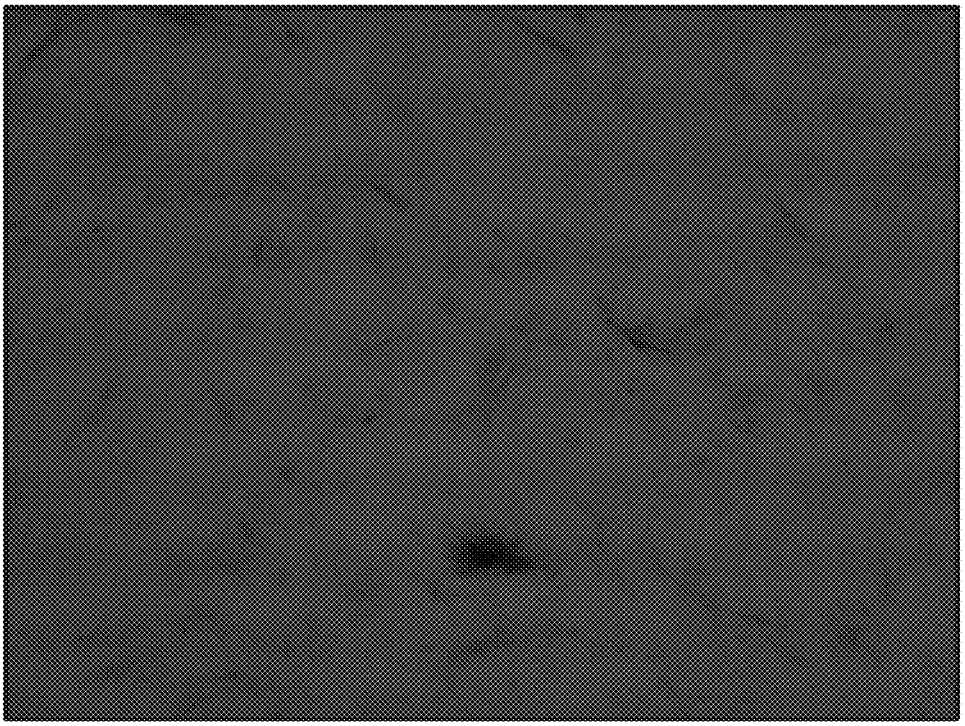
FIG. 6 is a photograph taken at 200× magnification of the liquid detergent composition of FIG. 4 after storing at room temperature for four months, showing homogenous structurant precipitate distribution and lack of settling/separation within the composition.

FIGS. 4-6 show results for Example 2, with FIG. 4 illustrating the visibly opaque nature of the liquid detergent composition after 24 hours. The graph of FIG. 5 corresponds to the liquid detergent composition of FIG. 4, which is visibly opaque. For the liquid detergent composition of Example 2, the yield point was measured at 1.479 Pa and 0.7844 Pa for two respective trials. After setting undisturbed for four months, a continuous phase was still observed in Example 2 as shown in FIG. 6.

Figure 7:
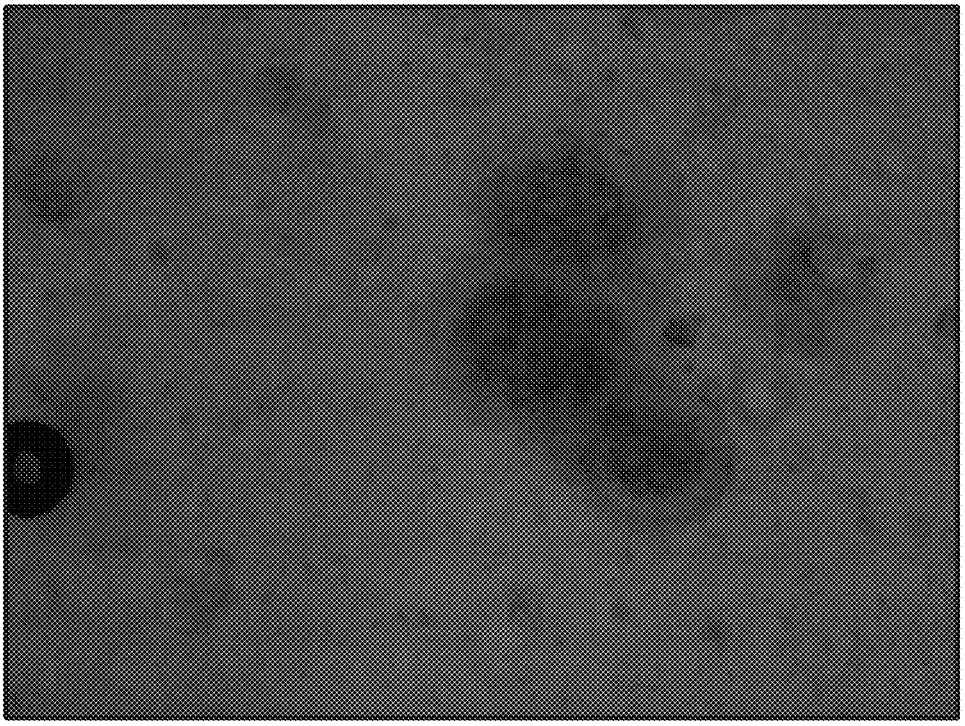
FIG. 7 is a photograph taken at 200× magnification of a liquid detergent composition of Comparative Example 2 after storing at room temperature for 3 days, showing settling/separation of structurant precipitate within the composition.

Referring to FIG. 7, results are shown in Comparative Example 2 in which settling/separation of structurant precipitate within the composition can be observed. Compared to the photograph in FIG. 6, differences in precipitate formation can be readily identified between compositions that exhibit non-Newtonian fluid behavior (e.g., Example 2) and compositions that do not sufficiently develop unacceptable phase separation (e.g., Comparative Example 2).

Figure 9:
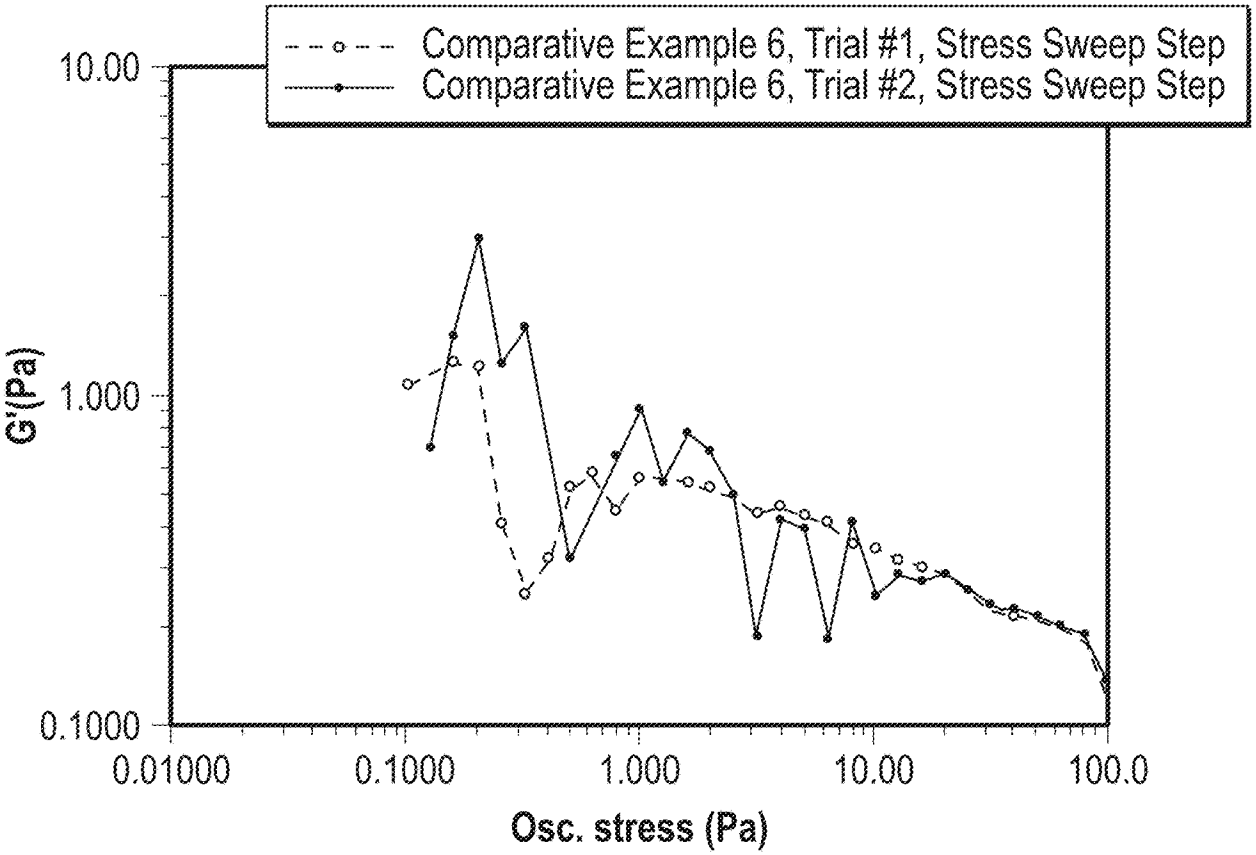
FIG. 9 is a graph of showing shear modulus (G') versus oscillatory stress for the comparative liquid detergent composition of FIG. 8, with the graph illustrating the composition to possess Newtonian fluid properties and no yield point.
Figure 8:
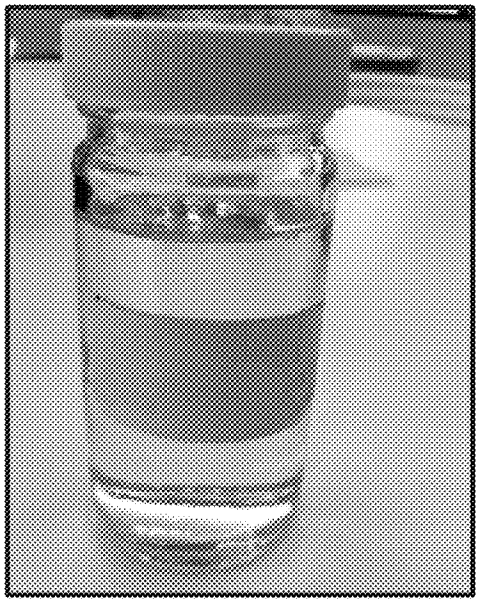
FIG. 8 is a photograph of a liquid detergent composition of Comparative Example 6, with the photograph illustrating the composition as being visually clear due to lack of structurant precipitation/structuring within the composition.

Referring to FIGS. 8 and 9, results are shown for Comparative Example 6 with FIG. 8 illustrating the visibly clear nature of the liquid detergent composition after 24 hours. The graph of FIG. 9 corresponds to the liquid detergent composition of FIG. 8, which is visibly clear. For the liquid detergent composition of Comparative Example 6, no yield point was detected and the fluid behavior is determined to be Newtonian.

Additional liquid detergent compositions were prepared and tested in the same manner as described above to illustrate the effect of including a particulate component in the compositions. The values shown in TABLE 3 below are in weight % based upon the total weight of the liquid detergent compositions.

TABLE 3

| | Comp. Ex. 7 | Ex. 3 |
|---|---|---|
| Glycerine | 8.00 | 8.00 |
| C12-C15 Alcohol Ethoxylate 7EO | 23.07 | 23.07 |
| Propylene Glycol | 7.00 | 7.00 |
| Neutralizers and Coconut Fatty Acids | 5.50 | 5.50 |
| Zeolite Water | 7.00 | 7.00 |
| Sodium C12-C14 Alcohol Ethoxysulfate 3EO (AES) (60% Active) | 22.72 | 22.72 |
| Enzyme Solution (~8% Active) | 1.50 | 1.50 |
| Optical Brightener | 0.20 | 0.20 |
| Thickener and Bittering Agents | 2.05 | 2.05 |
| PEG 400 | 20.96 | 12.96 |
| 1:1 DI Water to Microcapsule Slurry Dilution | 2.00 | 2.00 |
| PEG 8 Stearate | | 8.00 |
| Subtotal | 100.00 | 100.00 |
| Stability at Room Temperature (23.9° C.) | Unstable due to separation of microcapsules (creaming) after 2 days | Stable after 10+ days |

Example 3 has a visibly opaque nature of the liquid detergent composition after 4 days. Comparative Example 7 has visible separation of the composition.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A liquid detergent composition comprising:

a continuous phase and a particulate component suspended in the continuous phase;

wherein the continuous phase comprises an ionic surfactant and an alkoxylated linear fatty acid structurant, said structurant being solid at ambient temperature of about 21° C. and ambient pressure of about 100 kPa;

wherein the particulate component is different from the structurant;

wherein the detergent composition exhibits non-Newtonian fluid behavior at 24 hours following shear mixing cessation, and wherein the detergent composition exhibits Newtonian fluid behavior during a portion of the period of time starting at the shear mixing cessation until 24 hours following the shear mixing cessation;

wherein the alkoxylated linear fatty acid structurant comprises from about 6 to about 10 ethylenoxy units and further comprises propylenoxy unit(s).

2. The liquid detergent composition of claim 1, wherein the alkoxylated linear fatty acid structurant is formed from a C13-C22 fatty acid.

3. The liquid detergent composition of claim 1, wherein the alkoxylated linear fatty acid structurant is present in an amount of from about 5 to about 15 weight %, based upon a total weight of the liquid detergent composition.

4. The liquid detergent composition of claim 1, wherein the particulate component has a D90 average particle size of 150 microns or less.

5. The liquid detergent composition of claim 1, wherein the particulate component includes microcapsules comprising one or more active ingredients.

6. The detergent composition of claim 1, wherein the detergent composition exhibits Newtonian fluid behavior for at least 3 hours following the shear mixing cessation.

7. The detergent composition of claim 1, wherein the detergent composition is visibly opaque at 24 hours following shear mixing cessation and is visibly clear following shear mixing cessation for a period of at least 3 hours at about 21° C.

8. A single dose pack comprising:

a container, wherein the container comprises a water-soluble film; and a liquid detergent composition encapsulated within the container, wherein the detergent composition comprises:

a continuous phase and a particulate component suspended in the continuous phase, wherein the continuous phase comprises an ionic surfactant and an alkoxylated linear fatty acid structurant, wherein the structurant is solid at ambient temperature of about 21° C. and ambient pressure of about 100 kPa;

wherein the particulate component is different from the structurant; and wherein the detergent composition exhibits non-Newtonian fluid behavior at 24 hours following shear mixing cessation, and wherein the detergent composition exhibits Newtonian fluid behavior during a portion of the period of time starting at the shear mixing cessation until 24 hours following the shear mixing cessation;

wherein the alkoxylated linear fatty acid structurant comprises from about 6 to about 10 ethylenoxy units and further comprises propylenoxy unit(s).

9. The single dose pack of claim 8, wherein the alkoxylated linear fatty acid structurant is formed from a C13-C22 fatty acid.

10. The single dose pack of claim 9, wherein the alkoxylated linear fatty acid structurant is present in an amount of from about 5 to about 15 weight %, based upon a total weight of the liquid detergent composition.

* * * * *